United States Patent [19]

Morrow

[11] Patent Number: 5,040,686

[45] Date of Patent: Aug. 20, 1991

[54] ARRANGEMENT FOR HANGING BRASSIERES

[75] Inventor: Lester W. Morrow, Ossining, N.Y.

[73] Assignee: Marlboro Marketing, Inc., New York, N.Y.

[21] Appl. No.: 518,808

[22] Filed: May 4, 1990

[51] Int. Cl.[5] ..... A47F 7/00

[52] U.S. Cl. ..... 211/13; 211/113; 223/88

[58] Field of Search ..... 211/13, 113, 59.1, 205, 211/88; 223/88, 111

[56] References Cited

U.S. PATENT DOCUMENTS

| | | | |
|---|---|---|---|
| 1,204,618 | 11/1916 | Verkler | 211/113 X |
| 1,754,940 | 4/1930 | Freeman | 211/113 X |
| 2,608,306 | 8/1952 | Mills | 211/113 |
| 4,148,421 | 4/1979 | Levitt | 211/113 X |
| 4,653,678 | 3/1987 | Blanchard | 211/113 X |

OTHER PUBLICATIONS

Kanns Notions & Toiletries Catalog 9/1951.

*Primary Examiner*—Alvin C. Chin Shue
*Assistant Examiner*—Sarah A. Lechok
*Attorney, Agent, or Firm*—Darby & Darby

[57] ABSTRACT

A hanging arrangement which includes a hanger. The hanger has a central portion and two elongated hanger arms which extend away from the central portion. The central portion has an inner facing side which defines a space. The arms each hold shoulder straps of a brassiere in position against the arms so as to avoid relative movement of the shoulder straps where held with respect to the arms. The inner facing side has a portion at an elevation which is higher than where the shoulder straps of the brassiere are to be held against the arms. The arms each have a face which extends in a common plane. The faces each have a predetermined width so that if said faces are each projected through the space to intersect each other as would occur by further elongating the hanger arms toward each other, said portion of the inner facing side lies within said widths of the faces as projected. The space is adapted to accommodate a support member inserted therein so that the portion of the side rests against the support member.

14 Claims, 2 Drawing Sheets

ARRANGEMENT FOR HANGING BRASSIERES

DESCRIPTION OF THE PRIOR ART

The present invention is directed to hangers for holding brassieres and a display unit which supports a large number of the hangers and thereby the brassieres.

Retail stores which carry women's undergarments are generally known to provide stand alone display units which display a large number of brassieres on hangers. The typical hanger has two arms which extend horizontally away from each other and a hook extending vertically upward from between the arms. Each free end of the arm also has a hook which extends downward, on which is wrapped a shoulder strap of the brassiere.

A display unit in a retail store typically has extension rods which extend outward from a vertically extending base at different elevations. Each extension rod holds a finite number of hangers. The separation distance between the different levels must be at least the same size as the hanging distance of the hanger with brassiere. By maintaining such a separation distance, placing and removing the hangers on the extension rods is done without interference from an extension rod that is immediately beneath.

Hanging the brassiere on the typical hanger requires wrapping the shoulder strap around the ends of the horizontally extending hanger arms and securing the strap by fastening hooks at these ends. This is done to minimize the slack which would otherwise be evident from hanging and to ensure that the brassiere stays on the hanger.

The fastening hooks extend outside of the hanger arms, such as in the direction of elongation of the hanger arm on either side of the extension rod and also downward in a direction perpendicular to this direction of elongation. Each of these fastening hooks has a resilient extension which projects back in the opposite direction from which the rest of the fastening hook extends. Shoulder straps of the brassiere are held resiliently by the resilient extension of at least one of these fastening hooks at each end of the hanger. Such a prior art hanger is exemplified in U.S. Pat. No. 4,623,079. Due to the narrowness of such hanger arms, the shoulder straps must be wrapped around the hanger arms a large number of times to take up slack.

It would therefore be desireable to hang a brassiere on a hanger to both maintain a neat appearance and yet limit the number of times the shoulder straps must be wrapped around the hanger arms for obtaining an acceptable minimal amount of slack and to increase the number of units of hangers with brassieres which may be hung by a display unit.

SUMMARY OF THE INVENTION

The present invention is directed to a hanging arrangement which includes a hanger. The hanger has a central portion and two elongated hanger arms which extend away from the central portion. The central portion has an inner facing side which defines a space. The arms each have means for holding shoulder straps of a brassiere in position against the arms so as to avoid relative movement of the shoulder straps where held with respect to the arms. The inner facing side has a portion at an elevation which is higher than where the shoulder straps of the brassiere are to be held by said holding means against the arms. The arms each have a face with a predetermined width so that if said faces are each projected through the space to intersect each other as would occur by further elongating the hanger arms toward each other, the portion of the inner facing side lies within said widths of the faces as projected. The space is adapted to accommodate a support member inserted therein, such as an extension rod, so that the portion of the side may rest against the support member.

The present invention is further directed to hanging a brassiere from the hanger. Preferably, each of the arms have a slot and clip in alignment with each other which extend in the direction of elongation of the arms. Shoulder straps of the brassiere are resiliently held by the clips against the arms, respectively. The shoulder straps are wrapped around the arms, respectively, twice. If the hanger is rotated once relative to the brassiere, then the cups of the brassiere reach a face of the hanger.

The hangers may be supported by respective extension rods which project from a vertically extending base. Each extension rod is against an underside of an area of the portion of the inner facing side of a respective hanger arm. The hanger then balances on the extension rod at this area. The extension rods are at different elevations; the spacing between the extension rods at adjacent levels is equal to the full hanging length of the hanger with brassiere hanging from the hanger arms.

The ratio of the width and thickness of each hanger arm is greater than 2:1, preferably 15:1. Preferably, an elevation of the area of the portion of the inner facing side of the central portion is at most one inch higher than an uppermost elevation where said the shoulder straps are to be held in position against the arms by the holding means.

In order to vary the number of hangers which may be held by any one extension rod, the extension rod may be telescoping in which a rod is slidable back and forth in an elongated hollow housing.

BRIEF DESCRIPTION OF THE DRAWINGS

For a better understanding of the present invention, reference is made to the following description and accompanying drawings while the scope of the invention will be pointed out in the appended claims.

DESCRIPTION OF THE PREFERRED EMBODIMENT

Figure 1:
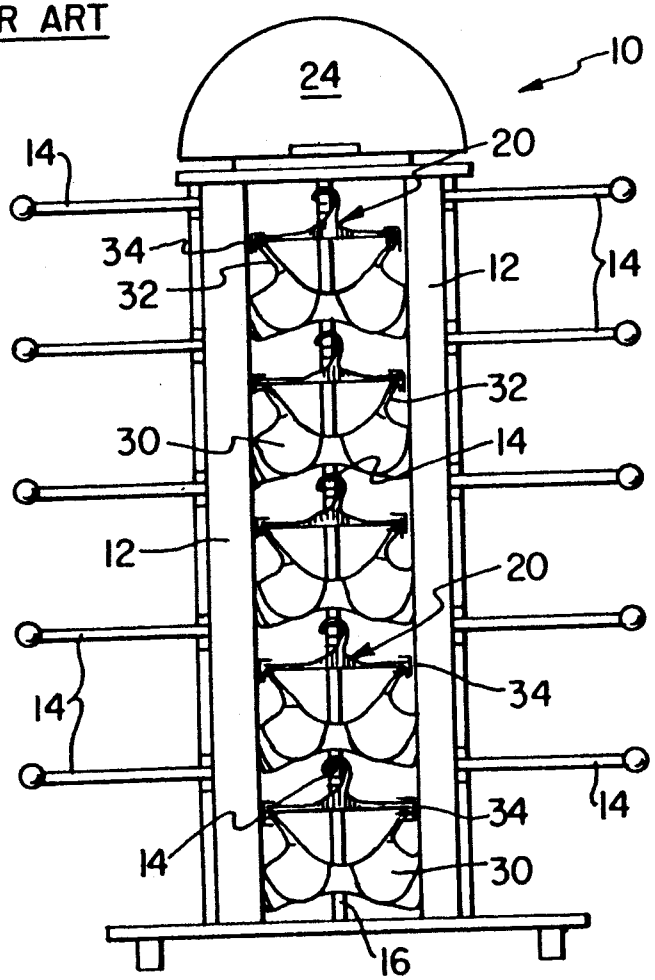
FIG. 1 PRIOR ART
FIG. 1 shows an elevational view of a display unit with hangers holding brassieres in accordance with the prior art.

Turning to the drawings, FIG. 1 shows a conventional display unit 10 which has a vertically elongated base 12 from which project extension rods 14 at different elevations from all four sides of the base 12. The extension rods 14 are spaced apart from each other and support conventional hangers 20, each of which support a brassiere 30. Shoulder straps 32 are wrapped around an end 22 of the hangers and held by resilient fastening hooks 34 to reduce the amount of slack present during hanging. Each end has three resilient fastening hooks; two extend on either side of the respective hanger arm in the direction of elongation of the hanger arm and the third fastening hook extends downward perpendicular to the other two.

The spacing between each level of extension rods 14 is sized to accommodate a hanger with brassiere hanging therefrom without creating any interference with extension rods beneath each level. The extension rods 14 are releasably securable into any one of a number of locking positions in the track 16 of the base 12. The base 12 rests on a base 18 and is capped by a dome 24. The free ends of the extension rods have balls attached thereto to provide a smooth end for safety reasons.

The display unit 10 may be made from any type of material, preferably metal, wood or a sturdy plastic. The top of the display unit is capped by a dome 24 which may be made from a colored translucent material and houses a light for illuminating the display. Illumination may also be provided vertically behind colored translucent strips which extend the height of the base 12 along each of the corners and face toward where the hangers are to be hung.

The extension rods 14 may be secured in position along track 16 in any number of known ways, such as by fastening screws which fit into holes in the track and through a support 15 which holds the extension rod 14.

Figure 2:
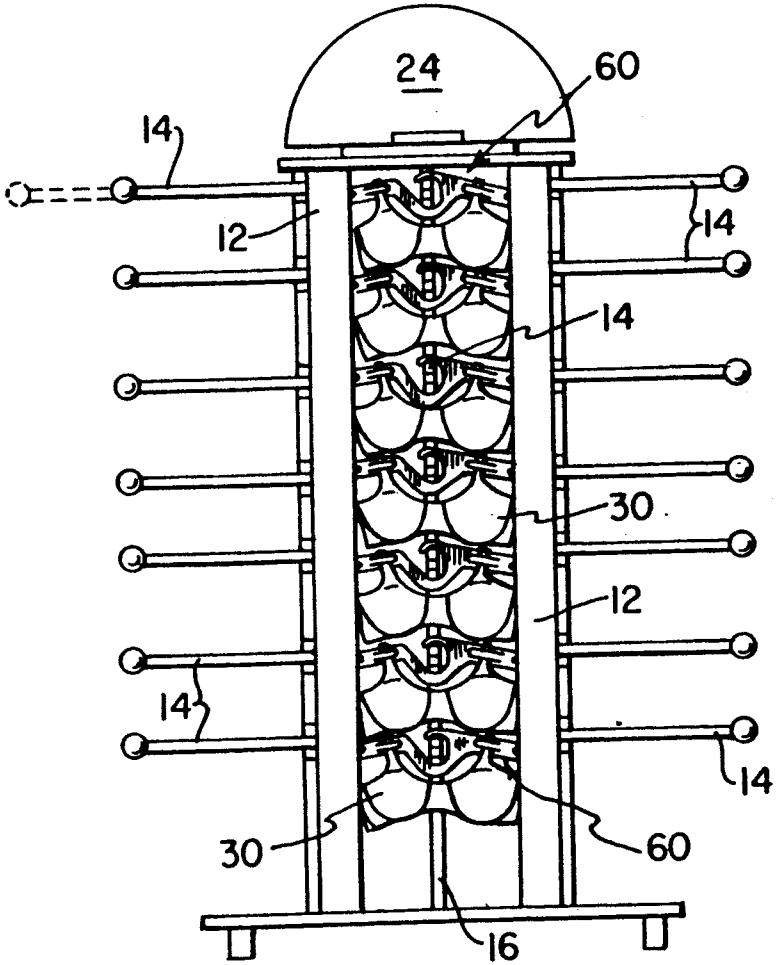
FIG. 2 shows an elevational view of a display unit having the same vertically extending base as the display unit of FIG. 1, but with hangers in accordance with the present invention which hold brassieres on a greater number of extension rods in accordance with the present invention.
Figure 3:
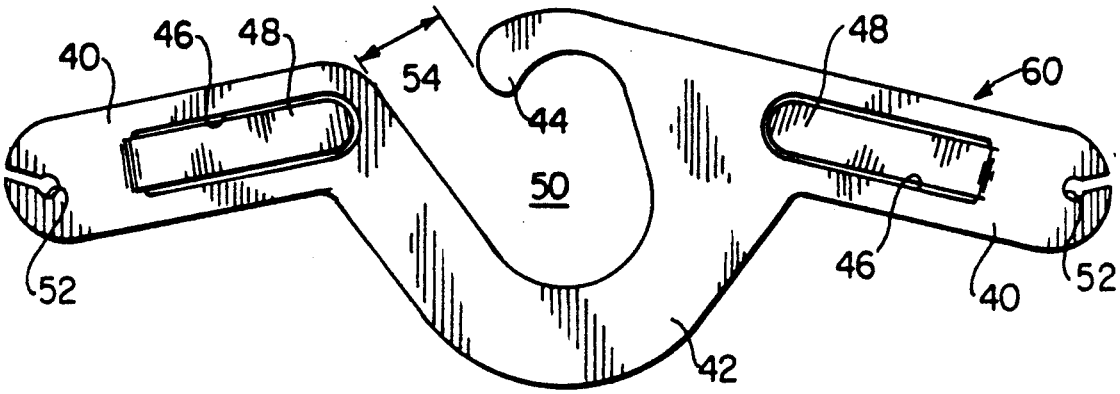
FIG. 3 shows a front side elevational view of the hanger in accordance with the present application.
Figure 4:
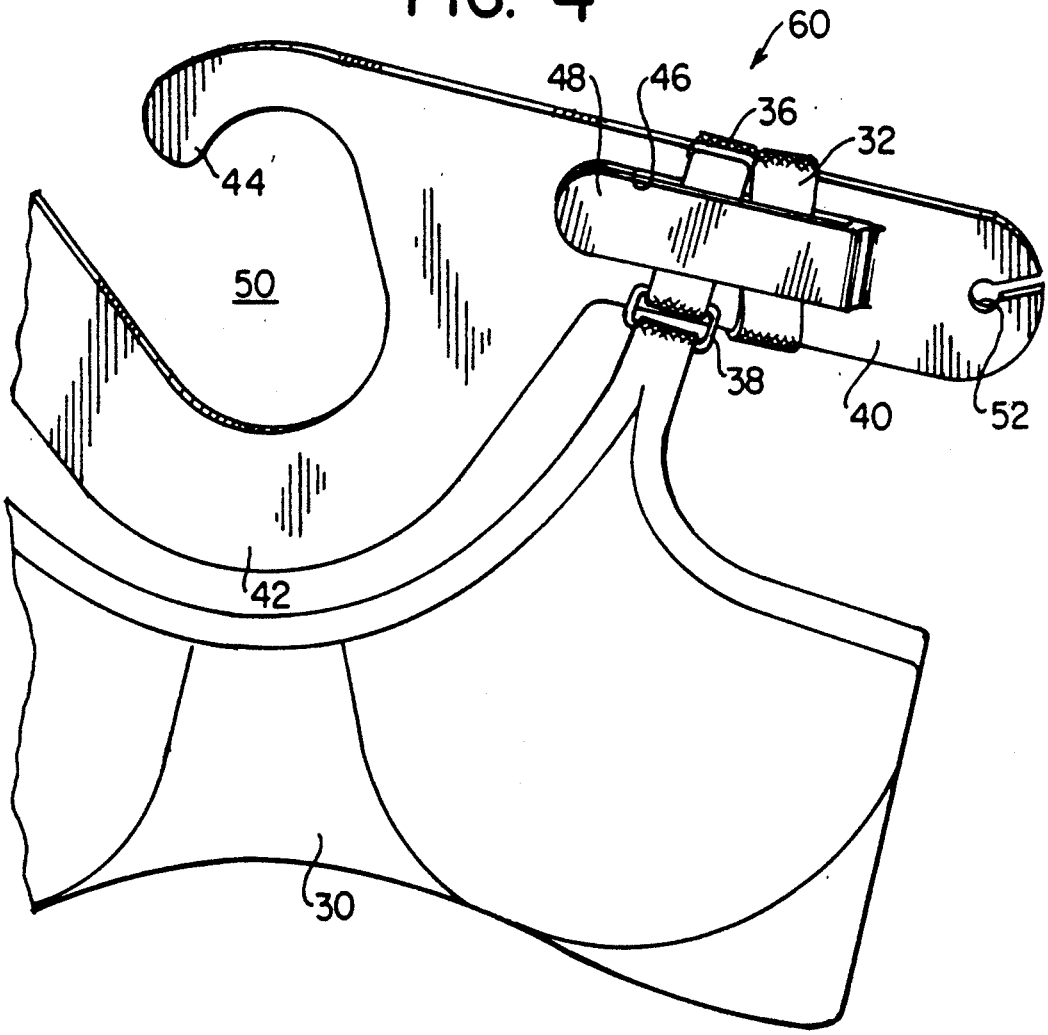
FIG. 4 shows a partial front perspective view of the hanger of FIG. 3 from which is hung a brassiere.

FIG. 2 shows the same display unit 10 as in FIG. 1, except that the hanger 60 of FIGS. 3–4 is employed in accordance with the present invention. By using the hanger 60 of the present invention, more space becomes available between the levels of hangars, thereby enabling more hangers to be arranged vertically one over the other in the same space than is possible in the conventional display unit 10 of FIG. 1.

The hanging height of a hanger with brassiere has been found to be, respectively, 12 inches for the CAMEO 2380 size 34B bra and 12½ inches for the CAMEO 2380 size 34D bra with a conventional hanger 20 as in FIG. 1 is employed. Surprisingly, the hanging height for these two units was reduced to 8 inches and 9¾ inches, respectively, when the hanger 60 of FIGS. 3–4 was employed instead of the conventional hanger 20.

The number of units (hangers with brassieres) which may be accommodated as between the display units and hangers of FIGS. 1 and 2 is 40 to 60 percent more with hangers of the present invention as opposed to that for conventional hangers. The following table is illustrative:

| Hanger of | Display Height | Size Bra | Total number of units held | Percentage increase with FIG. 2 |
|---|---|---|---|---|
| FIG. 1 | 59" | 36D | 96 | |
| FIG. 2 | 59" | 36D | 144 | 50 |
| FIG. 1 | 59" | 34B | 120 | |
| FIG. 2 | 59" | 34B | 168 | 40 |
| FIG. 1 | 64" | 34B | 120 | |
| FIG. 2 | 64" | 34B | 192 | 60 |

If desired, space for additional hangers may be provided by employing telescoping extension rods.

FIGS. 3–4 show a hanger 60 of uniform thickness for holding brassieres in accordance with the present invention, except that each elongated tong or clip 48 can be considered to be a cut out from a respective hanger arm 40 to form an elongated slot 46. Hanger 60 actually has two hanger arms 40 which extend from an interconnecting portion 42. Each hanger arm has a face which defines a width of the hanger arms and extends in a common plane with each other.

There is a hook 44 which is higher than the hanger arms and extend from at most one of the arms. The interconnecting portion 42 and hook 44 may together be considered a central portion which defines a space or opening 50. Preferably, the hanger arms incline downward and away from the interconnecting portion 42, so as to avoid the tendency for the hanger 60 to otherwise topple if the hook 44 were lower relative to the hanger arms 40.

Each hanger arm 40 has a respective elongated slot 46 and a respective elongated clip 48 extending along the length of the slot 46 but behind the slot 46. The clip 48 is secured to the respective hanger arm 40 by a lower end of the slot and has the shape of the slot 46. Since the clip 48 has a distant free end, it is somewhat resilient for accommodating a wrapping of shoulder straps of a brassiere 30 as shown in FIG. 4. The clip 48 presses against these straps to secure them in position. Preferably, clip 48 and slot 46 conform in shape to each other; the clip 48 may be a cut out of the slot 46. Both the clip 48 and slot 46 are preferably in alignment with each other. The clip extends preferably adjacent to an end of the elongated slot 46.

At the far end of each hanger arm are grooves 52 between which may be stretched panties which are thereby held. The interconnecting portion 42 defines a space 50 in which may be fit a respective extension rod 14 from the base 12 via a gap 54 between the hook 44 and one of the hanger arms 40.

By arranging the hook 44 to lie within projected widths of faces of the hanger arms (as may be envisioned if the hanger arms are projected to intersect each other so as to further extend the hanger arms far enough toward each other to intersect), a savings of about 1¼ in height is realized over the conventional hanger. Preferably, the distance between the uppermost location where the shoulder straps are held to the arms and the area on the hook 44 which will lie against the extension rod 14 is less than one inch so as to minimize the upward projection of the hook 44 and still ensure stability of the hanger.

Further savings in the overall hanging height is realized by the manner in which the brassiere is hung on the hanger 60 in accordance with the present invention as compared to that for the prior art. This involves contributions from the wider and inclined hanger arms and the resilient clips which allow the brassiere to hang closer to the hanger than on the prior art hangers. The large area which comprises the interconnecting portion 42 helps to stabilize the hanger on the extension rod and serves as a guide around which the brassiere is to hang.

By extending the hook 44 to lie within the projected widths of the faces of the hanger arms, the distance to which the hook 44 extends relative to where the brassieres are to be hung may be kept a minimum. Gap 54 enables store personnel or customers to quickly remove a selected hanger and brassiere unit off an extension rod.

If all the brassieres being hung from any one extension rod are identical, there is no need for gap 54, because customers may pull off the hangers in succession over the free end of the extension rod 14. Therefore, the hook 44 may be extended to fill in this gap 54 so that the hook 44 in effect interconnects the hanger arms with each other. With such a configuration, even the interconnecting portion 42 may be dispensed with, although retaining the interconnecting portion 42 provides advantages such as greater stability against toppling and as a barrier between the brassiere and the extension rod.

As can be seen in FIG. 4, clips 48 resiliently press the shoulder straps 32 against the hanger arms 40. Wrapping is effected by inserting the shoulder strap between the clip 48 and extension rod 40, wrapping the shoulder strap entirely around the hanger arm to return to between the clip 48 and extension rod 40. Thus, the shoulder strap is looped once around the hanger arm so that the beginning and end of the loop is held by the clip. The shoulder strap is wrapped again to hang freely.

Preferably, one of the clips 36 on the shoulder strap 32 and a ring 38 on the shoulder strap 32 are on either side of the clip 48 to help clamp the shoulder strap 32 in place between the clip 48 and hanger arm 40. While not absolutely necessary, one full rotation of the hanger relative to the hanging brassiere will bring the cups of the brassiere against a face of the hanger so as to reduce the overall hanging distance even further and yet maintain a neat appearance.

The preferred width or height of each of the hanger arms is about 1¼ inches or more to minimize the number of times the shoulder straps need be wrapped around the hanger arms to minimize slack. Conventional hangers as in FIG. 1 have a width of less than ⅜ inches—at least four times smaller than the preferred height of the hangers in accordance with the present invention. Thus, the shoulder straps are wrapped four times more around the hanger arm with the conventional hanger to take up the same amount of slack as can be obtained by a single rotation of the hanger in accordance with the preferred embodiment of the present invention. If the total perimeter of the hanger arms are considered across the faces and sides (where the shoulder straps are to be wrapped), the perimeter of the hanger arms of FIG. 3 is 4 to 5 times greater than that of the hanger arms of FIG. 1. While this perimetrical distance is advantageous in allowing the brassiere to hang as shown in FIG. 4, any distance greater than that of the conventional hanger of FIG. 1 would also fall within the scope of the present invention.

The present invention therefore requires a fewer number of full wrappings of the shoulder straps around the hanger than is required for conventional hangers. The prior art hanger of FIG. 1 has a width to thickness ratio for its arms of less than 2:1 (if the width of outward projections at the bottom and top of the hanger arms are taken into account).

Preferably, the height of the hanger arms are each more than two times greater than the thickness of the hanger arms, i.e., at least 15 times to minimize the number of times the shoulder strap is wrapped around the hanger arms to two loops. If further reduction in overall hanging height is desired, the hanger need only be rotated once from this position relative to the brassiere to cause the cups of the brassiere to lie against the hanger.

Prior to shipment, such a hanger may be quickly wrapped by the shoulder straps by looping the straps twice around each of the arms and underneath the clips, respectively. The resilient force of the clips 48 will prevent the brassiere 30 from falling off during shipment.

For the sake of brevity, the reverse side of FIG. 3 is not shown in a separate drawing, but its surface is flat and appears essentially identical to that of FIG. 3, except that slots 46 appear as wide as the clips 48 and the clips 48 are visible through the slots 46.

Preferably, the upper surfaces of the hanger arms which define the thickness of the hanger arms and extend in the direction of elongation of the hanger arms may be projected to intersect each other such that an uppermost side of the central portion lies within a prism which is constituted by the surfaces being projected to intersect each other and a plane which extends between ends of the surfaces from the free ends of the hanger arms.

Further, the hanger arms may extend at oblique angles relative to each other so as to substantially conform in shape to a lower edge of a brassiere hanging from an identical hanger.

While the foregoing description and drawings represent the preferred embodiments of the present invention, it will be understood that various changes and modifications may be made without departing from the spirit and scope of the present invention.

What is claimed is:

1. A hanging arrangement, comprising:

a hanger which includes two elongated arm members, a connecting member which extends between said arm members and connects said arm members with each other, said connecting member extending transversely to the directions of elongation of said arm members, a hook member extending from one of said arm members and terminating at a free end, said arm members inclining away from said hook member, and releasable holding means extending from each of said arm members for releasably holding shoulder straps of a brassiere on said arm members against relative movement, said hook member and interconnecting members and one of said arm members being configured and arranged relative to each other for enabling insertion of a support element through a gap between said free end and said one arm member to a space immediately adjacent to said gap, said space being defined by an inwardly-facing contour of said hook and connecting member, a portion of said inwardly-facing contour of said hook member facing said space and being arranged for balancing the hanger when resting on the support element, said portion of said inwardly-facing contour of said hook member lying substantially within the confines of a triangle which is constituted by three sides that extend between three points, two of said points being respectively at locations where said releasable holding means extends from each of said arm members, said arm members and a third of said points being at an intersection of lines which extend through said arm members in the direction of elongation of said arm members.

2. A hanging arrangement as in claim 1, wherein said holding means includes respective clips extending from and in said direction of elongation of said arm members, respectively, said clips being resilient for resiliently holding the shoulder straps against said arm members.

3. A hanging arrangement as in claim 2, wherein said arm members each have a respective elongated slot in alignment with said clips, respectively.

4. A hanging arrangement as in claim 3, wherein said clips and slots conform in shape to each other.

5. A hanging arrangement as in claim 1, further comprising a brassiere having shoulder straps wrapped around said arm members and hanging from said arm members.

6. A hanging arrangement as in claim 2, further comprising a brassiere hanging from said arm members with shoulder straps resiliently held by said clips against said arm members, respectively.

7. A hanging arrangement as in claim 1, further comprising a plurality of vertically stacked, generally horizontal extension rods, said portion of said inwardly facing contour of each of a plurality of said hook members being in contact with a respective one of said extension rods, said respective one of said extension rods constitutions said support element, said extension rods being adapted to support a plurality of hangers in a generally vertical plane.

8. A hanging arrangement as in claim 6, wherein each of said shoulder straps is looped at most twice around said respective arm members so as to extend between said clip and said arm members, respectively.

9. A hanging arrangement as in claim 1, wherein said arm members each have a face with a width that is more than two times greater than a thickness of said arm members.

10. A hanging arrangement as in claim 9, wherein said width is at least fifteen times greater than said thickness of said arm members.

11. A hanging arrangement as in claim 1, wherein said portion of said inwardly-facing contour of said hook member is in contact with an extension rod for balancing said hanger on said extension rod, said area being at an elevation which is at most one inch above an uppermost elevation at which said shoulder straps are held against said arm members, said extension rod being the support element.

12. An arrangement as in claim 1, wherein said hook member extends from the other of said hanger arms.

13. An arrangement as in claim 5, wherein said hanger with the brassiere hanging therefrom provide an overall hanging height of 8 to 9¾ inches at most.

14. An arrangement as in claim 7, wherein said plurality of extension rods are spaced apart from each other one over the other for enabling accommodation of seven extension rods within a vertical display height of 59 to 64 inches, the vertical display height being constituted by a total of distances of hanging heights of a brassiere hanging from a respective hanger on each of the extension rods.

* * * * *